US008510866B2

(12) United States Patent
Mizumoto

(10) Patent No.: US 8,510,866 B2
(45) Date of Patent: Aug. 20, 2013

(54) GOLF GLOVES

(76) Inventor: Takayuki Mizumoto, Kawaguchi (JP)

( * ) Notice: Subject to any disclaimer, the term of this patent is extended or adjusted under 35 U.S.C. 154(b) by 28 days.

(21) Appl. No.: 13/138,971

(22) PCT Filed: May 10, 2010

(86) PCT No.: PCT/JP2010/058246

§ 371 (c)(1),
(2), (4) Date: Nov. 7, 2011

(87) PCT Pub. No.: WO2010/128689

PCT Pub. Date: Nov. 11, 2010

(65) Prior Publication Data

US 2012/0047625 A1 Mar. 1, 2012

(30) Foreign Application Priority Data

May 8, 2009 (JP) ..... 2009-113665

(51) Int. Cl.
*A41D 19/00* (2006.01)

(52) U.S. Cl.
USPC ..... 2/161.2

(58) Field of Classification Search
USPC ..... 2/159, 161.2, 160.1, 160, 161.4, 2/161.6, 170
See application file for complete search history.

(56) References Cited

U.S. PATENT DOCUMENTS

| | | | | |
|---|---|---|---|---|
| 3,847,110 | A * | 11/1974 | Inoue | 116/223 |
| 5,730,658 | A * | 3/1998 | Kurtz et al. | 473/205 |
| 6,052,828 | A * | 4/2000 | Widdemer | 2/161.2 |
| 6,286,148 | B1 * | 9/2001 | Meyer | 2/161.1 |
| 8,060,947 | B2 * | 11/2011 | Voravan | 2/161.2 |

FOREIGN PATENT DOCUMENTS

| | | |
|---|---|---|
| JP | H04-263879 | 9/1992 |
| JP | H07-000208 | 1/1995 |
| JP | 2005-124597 | 5/2005 |

* cited by examiner

*Primary Examiner* — Tejash Patel
(74) *Attorney, Agent, or Firm* — Manabu Kanesaka

(57) ABSTRACT

The present invention provides a golf glove which allows a golfer to wear it or further fasten up the attachment member without bothering other players near the teeing ground or the putting green. When a dial member 13 is rotated in a clockwise direction with respect to a guide member 12, an interlocking groove 13D of a dial member 13 pulls a head portion 11D of an interlocking protrusion of a plate member in a direction indicated by the left pointing arrow along a long guide hole 12A of the guide member 12, and thus the guide member 12 on the attachment member 1C moves relatively in a direction of tightening up the attachment member 1C and the golf glove is put on a hand. When the dial member 13 is further rotated in a clockwise direction, the attachment member 1C is tightened up so that the worn golf glove fits more closely to the hand. No rasping and uncomfortable ripping noises which are peculiar to plane fasteners used in a conventional golf glove will be generated.

6 Claims, 16 Drawing Sheets

GOLF GLOVES

RELATED APPLICATIONS

The present application is National Phase of International Application No. PCT/JP2010/058246 filed May 10, 2010, and claims priority from Japanese Application No. 2009-113665, filed May 8, 2009, the disclosure of which is hereby incorporated by reference herein in its entirety.

TECHNICAL FIELD

The present invention relates to a golf glove, more specifically a golf glove having an attachment member for tightening up by lapping over and attaching to back of hand in a removable manner.

BACKGROUND ART

Conventionally, a golf glove having an attachment member for tightening up by lapping over and attaching to back of the hand in a removable manner is generally known. In this kind of golf gloves, in general, the attachment member is attached to the back of the hand by a hook-and-loop fastener (plane fastener) in a removable manner (see Japanese Laid-open patent application No. 2007-029318, for example).

DISCLOSURE OF INVENTION

Problems to be Resolved by the Invention

According to a golf glove disclosed in Japanese Laid-open patent application No. 2007-029318, the attachment member for tightening up is attached to the back of the hand in a removable manner by a hook-and-loop fastener. Thus, rasping and uncomfortable ripping noises which are peculiar to hook-and-loop fasteners are generated when the fastener member is ripped from the back of the hand.

Many of golfers playing in a golf course tend to wear golf gloves on the teeing ground during waiting for their turns, while tend to take off the golf gloves during walking on the fairway and before putting on the putting greens. As a golfer's mind, a golfer is tempted to rip the fastener member from the back of the hand once, and tighten up it again in order that the already worn golf glove more tightly fits to the hand when it is near his or her turn.

It is necessary to rip the fastener member which was attached to the back of the hand portion by a hook-and-loop fastener first before wearing the conventional golf glove. At that time, rasping and uncomfortable ripping noises which are peculiar to hook-and-loop fasteners are generated. Similarly, rasping and uncomfortable ripping noises are generated when the fastener member of the already worn golf glove is tightened up again.

If a golfer puts on a golf glove or fastens up the fastener member near other player on the teeing ground or the putting green, rasping and uncomfortable noises which are peculiar to hook-and-loop fasteners may reach the ears of the other player and bother her or his play due to a degraded ability to concentrate. A golfer who attaches a high value to good manners has to avoid such situations as much as possible.

The present invention is made in view of the situations to provide a golf glove which allows a golfer to put on and further tighten up a fastener member without bothering other players by noises even near the teeing ground and the putting green.

Means for Solving the Problems

In order to address the above mentioned problem, a golf glove having a fastener member which laps over the back of the hand and is attached thereto in a removable manner for tightening up it, and an attaching device positioned between the back of the hand and the fastener member for adjusting the position of the fastener member in a direction of tightening up it.

In a golf glove according to the present invention, a golf glove is put on a hand by attaching an attachment member to the back of the hand using an attaching device. By adjusting the position of the attachment member using the attaching device in a direction of tightening up, the attachment member is further tightened up so that the worn golf glove fits more closely to the hand. At this time, no rasping and uncomfortable ripping noises which are peculiar to hook-and-loop fasteners used in a conventional golf glove will be generated.

In a golf glove according to the present invention, an attaching device comprises a plate member which is positioned on the side of the back of the hand and a guide member and a dial member which are positioned on the side of an attachment member, the plate member has an interlocking protrusion which can be interlocked with an interlocking groove or an interlocking arm which is formed on the dial member passing through a long guide hole which is formed on the guide member, the dial member is rotatable with respect to the guide member and its position is adjustable in a rotational direction. It is further configured so that the attachment member can be attached to the back of the hand portion and the attachment member can be moved in a direction of tightening up, by rotating the dial member and pulling the interlocking protrusion of the plate member with the interlocking groove or the interlocking arm along the long guide hole of the guide member.

In this case, when the dial member is rotated in a predetermined direction with respect to the guide member, the interlocking protrusion of the plate member is pulled toward the interlocking groove or the interlocking arm of the dial member along the long guide hole on the guide member, the dial member moves in a direction of tightening up the attachment member, and the golf glove is put on a hand. When the dial member is further rotated in a predetermined direction, the attachment member is further tightened up so that the worn golf glove fits more closely to the hand.

In a golf glove having the guide member according to the present invention, the long guide hole can be replaced by an opening formed on the guide member through which the interlocking protrusion of the plate member passes. In this case, when the dial member is rotated in a predetermined direction with respect to the guide member, the interlocking protrusion of the plate member is pulled by the interlocking groove or the interlocking arm, and then the dial member moves in a direction of tightening up the attachment member and the golf glove is put on a hand. When the dial member is further rotated in a predetermined direction, the attachment member is further tightened up the attachment member so that the worn golf glove fits more closely to the hand.

Alternatively, in a golf glove according to the present invention, an attaching device may comprise a base member which is positioned on the side of the back of the hand and a cover member which is positioned on the side of an attachment member, the cover member is removable with respect to the base member and its position is adjustable in a direction of tightening up the attachment member through a ratchet mechanism, and at least one of the base member or the cover member is constituted by an elastic material.

In this case, the golf glove is put on a hand by locking the cover member with respect to the base member through a ratchet mechanism. The attachment member is further tightened up so that the worn golf glove fits more closely to a hand by adjusting the position of the cover member in a direction of tightening up the attachment member through a ratchet mechanism.

Further alternatively, in a golf glove according to the present invention, an attaching device may comprise a base member which is positioned on the side of the back of the hand and a slide member which is positioned on the side of an attachment member, the position of the slide member can be adjusted with respect to the base member in a direction of tightening up the attachment member through attraction by a magnet.

In this case, the golf glove is put on a hand by attracting the slide member with respect to the base member through a magnet. The attachment member is further tightened up so that the worn golf glove fits more closely to a hand by adjusting the position of the slide member in a direction of tightening up the attachment member by attracting through a magnet.

Yet further alternatively, in a golf glove according to the present invention, an attaching device may comprise a base member which is positioned on the side of the back of the hand and a cover member which is positioned on the side of an attachment member, and at least part of at least one of the base member or the cover member is constituted by a synthetic resin material which is self-adherence and removable.

In this case, the golf glove is put on a hand by lapping the cover member over the base member and pressing a surface of the side of the cover member, and then the cover member and the base member are easily fixed in a removable manner, wherein at least one of the cover member or the base member is formed by a material which is self-adherence and removable. At this time, the attachment member is further tightened up so that the worn golf glove fits more closely to a hand by detaching the cover member from the base material after the cover member was once fixed to a particular position on the base member, further adjusting the position of the cover member in a direction of tightening up the attachment member and pressing again a surface on the side of the cover member.

Effect of the Invention

In a golf glove according to the present invention, the golf glove can be put on a hand by attaching an attachment member to the back of the hand through an attaching device. The attachment member can be further tightened up so that the worn golf glove fits more closely to the hand by adjusting the position of the attachment member in a direction of tightening up through the attaching device. At this time, since no rasping and uncomfortable ripping noises which are peculiar to hook-and-loop fasteners used in a conventional golf glove will be generated, the golf glove can be put on or the attachment member can be further tightened up without bothering other players even when such actions are taken place near the teeing ground or the putting green.

EMBODIMENT FOR PRACTICING INVENTION

Embodiments for implementing a golf glove according to the present invention will be described below by referring to drawings. A golf glove according to the present invention is put on the left hand of a right-handed golfer and is put on the right hand of a left-handed golfer, in general. Since the golf gloves for a right-handed golfer and a left-handed golfer are configured bilaterally symmetric, one of them will be described and the other will not be explained here.

First Embodiment

Figure 1:
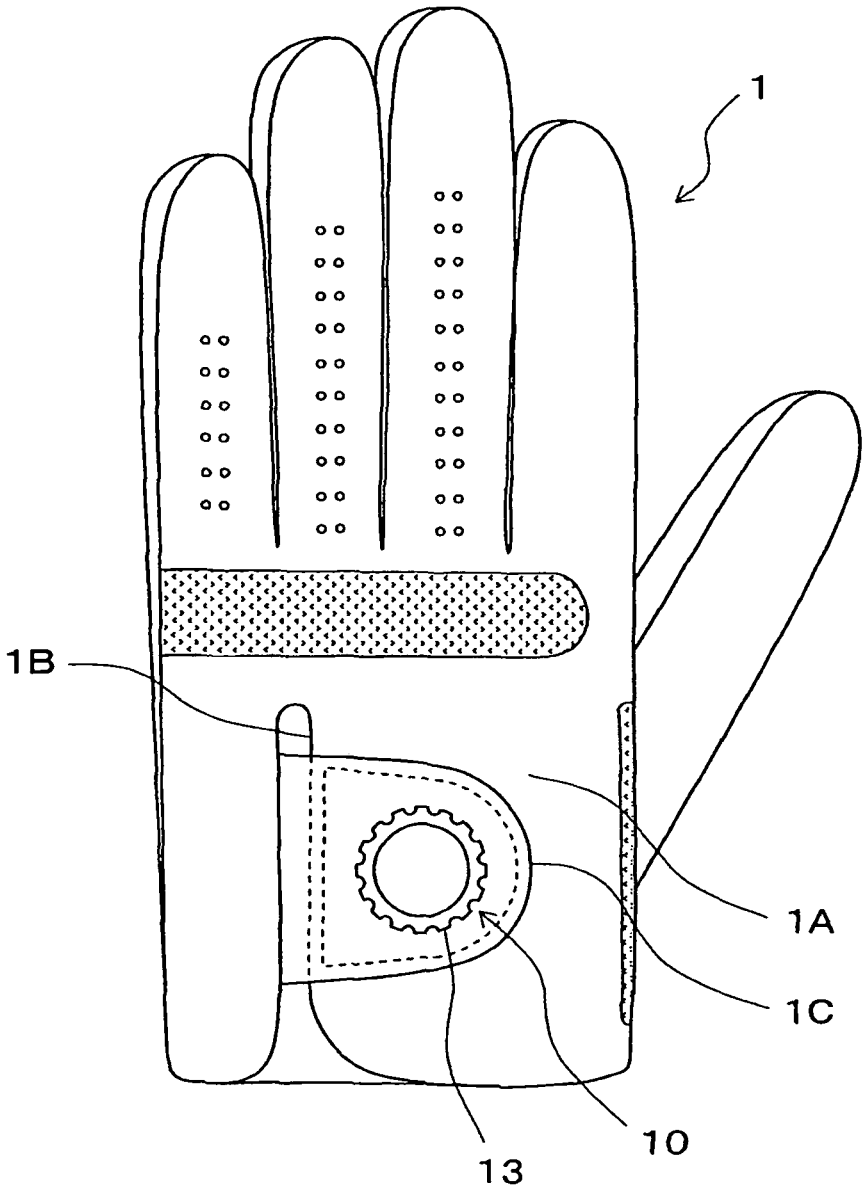
FIG. 1 is a diagrammatic perspective view of an appearance of a golf glove according to a first embodiment of the present invention which is viewed from the side of the back of the hand.
Figure 2:
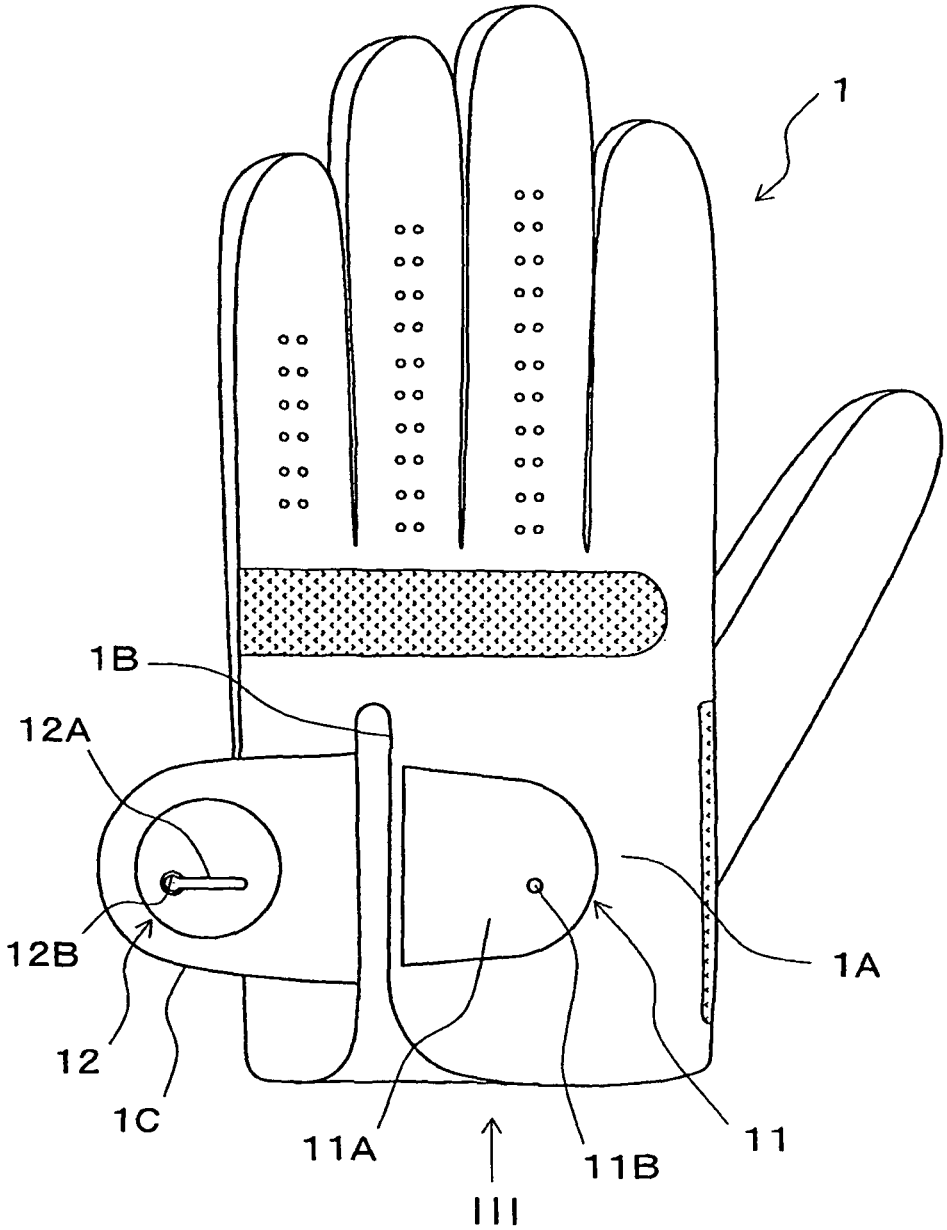
FIG. 2 is a diagrammatic perspective view of a golf glove which corresponds to the one shown in FIG. 1 showing a condition that the attachment member shown in FIG. 1 is folded back.

A golf glove 1 according to a first embodiment shown in FIG. 1 and FIG. 2 is to put on the left hand of a right-handed golfer in general and is sewn by appropriately combining a mesh material having stretch properties with a leather material like natural leather, artificial leather or synthetic leather.

In this golf glove 1, a slit 1B is formed on the side nearer a little finger of the back of the hand 1A, and an attachment member 1C for tightening up is provided on the left edge portion of the slit 1B in an extended condition so that the attachment member 1C can be lapped over part of the back of the hand 1A which is on the right of the slit 1B.

An attaching device 10 is positioned between the back of the hand 1A and the attachment member 1C for attaching the attachment member 1C so that its position is adjustable in a direction of tightening up. A plate member 11 is mounted on the side of the back of the hand 1A, and a guide member 12 and a dial member 13 are positioned on the side of the attachment member 1C.

The plate member 11 has a plate portion 11A which can be covered by the attachment member 1C and an interlocking protrusion 11B which is provided on the surface of the plate portion 11A in an extended condition. The plate portion 11A and the interlocking protrusion 11B are integrally formed by an appropriate synthetic resin. Although the plate portion 11A shown in the example of drawings is formed in a tongue like shape which is smaller than the attachment member 1C, the shape of the plate portion 11A can be modified to an appropriate shape and a size as long as it can be covered by the attachment member 1C.

Figure 3:
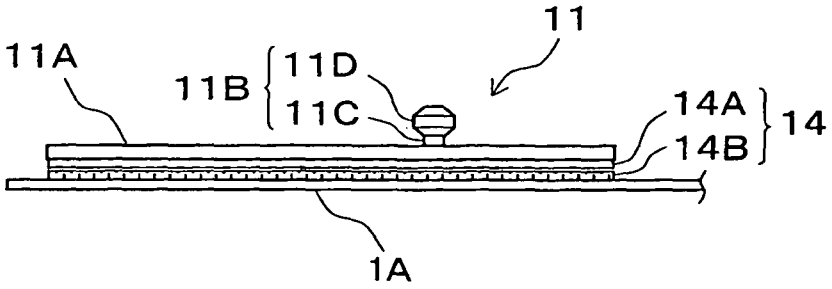
FIG. 3 shows a view from the direction indicated by the III arrow of the golf glove shown in FIG. 2.

The plate portion 11A may be directly bonded or stitched to the back of the hand 1A, however in this embodiment the plate portion 11A is removable from the back of the hand 1A through a couple of plane hook-and-loop fasteners 14A and 14B which have the same shape as the plate portion 11A. That is, as shown in FIG. 3, the plane fastener 14A having a lot of loops is bonded to the rear surface of the plate portion 11A. The plane fastener 14B having a lot of hooks is bonded or stitched to the front surface of the back of the hand 1A. The plate portion 11A is removable from the back of the hand 1A through these plane fasteners 14A and 14B.

On the other hand, as shown in FIG. 3, an interlocking protrusion 11B of the plate member 11 has a neck portion 11C and a head portion 11D. The head portion 11D has a larger diameter than the neck portion 11C which continues from the head portion 11D to the plate portion 11A. Although the head portion 11D is formed in a three dimension shape having a longitudinal cross-section of a little bit horizontally long octagon shape as shown in the drawing, it may have a short columnar shape or a spherical form. The head portion 11D is positioned so that it can pass through the start point portion 12B of the long guide hole 12A which is formed in the guide member 12 shown in FIG. 2.

Figure 4:
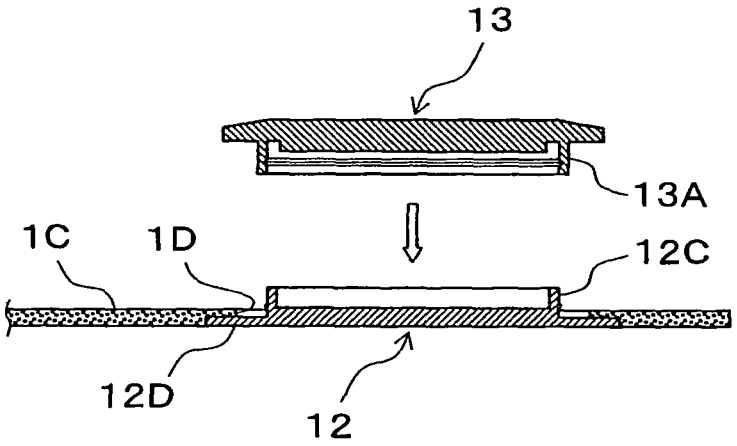
FIG. 4 is a longitudinal cross-sectional view of a guide member and a dial member which constitute an attaching device of a golf glove according to the first embodiment.

As shown in FIG. 4, the guide member 12 is formed in a reverse cap shape having a flange which is interlocked with the dial member 13 having a cap shape. The guide member 12 has an interlocking cylinder portion 12C to which an interlocking cylinder portion 13A is interlocked as socket and spigot in a rotatable manner and a circular flange portion 12D which extends from the bottom end of the cylinder portion 12C. The guide member 12 and the dial member 13 can be formed by an appropriate synthetic resin material or a light metal material like aluminum.

Figure 5:
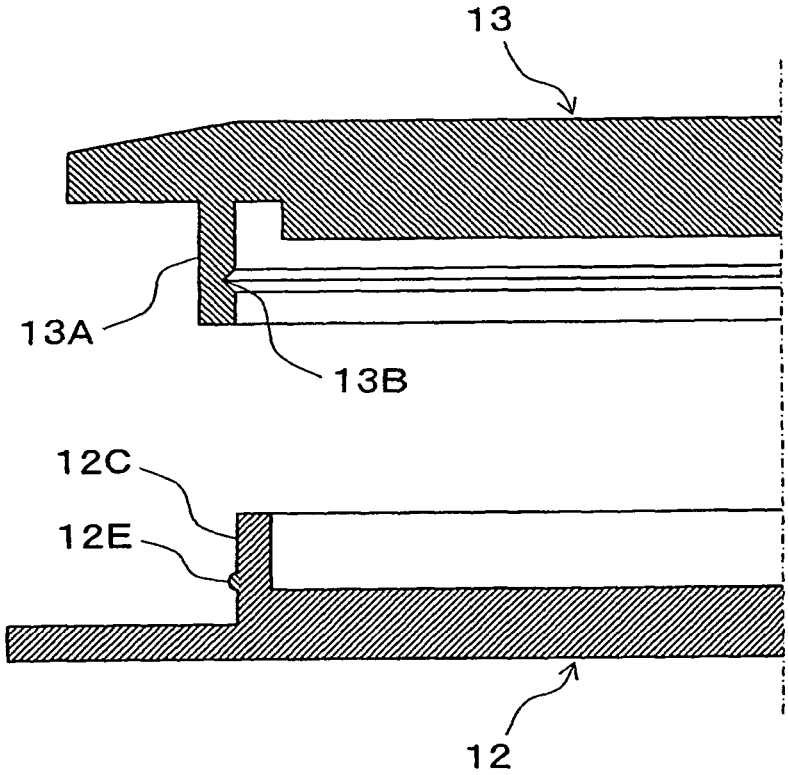
FIG. 5 is a half cross-sectional view which enlarges the guide member and the dial member shown in FIG. 4.

An interlocking portion is formed between the outer circumference of the interlocking cylinder portion 12C of the guide member 12 and the inner circumference of the interlocking cylinder portion 13A of the dial member 13 for interlocking the dial member 13 with the guide member 12 in a removable manner so that a certain clicking is felt in a direction of interlocking. For example, as shown in the enlarged view in FIG. 5, a ring shaped convex portion 12E having a cross-sectional shape of a half circle is formed on the outer circumference of the interlocking cylinder portion 12C of the guide member 12, and a ring shaped V-formation groove 13B having a cross-sectional shape of V-formation is formed on the inner circumference of the interlocking cylinder portion 13A of the dial member 13.

Although it is not shown in drawings, an appropriate clicking mechanism is formed between the outer circumference of the interlocking cylinder portion 12C of the guide member 12 and the inner circumference of the interlocking cylinder portion 13A of the dial member 13 for enabling the dial member 13 to determine its position in a rotational direction by a plurality of miniature concavo-convex interlocking portions. In order to give elastic characteristics in a radial direction to the interlocking cylinder portion 13A of the dial member 13, a plurality of slits may be formed in the interlocking cylinder portion 13A, or alternatively an appropriate thin portion may be formed at the base end portion of the interlocking cylinder portion 13A.

Figure 6:
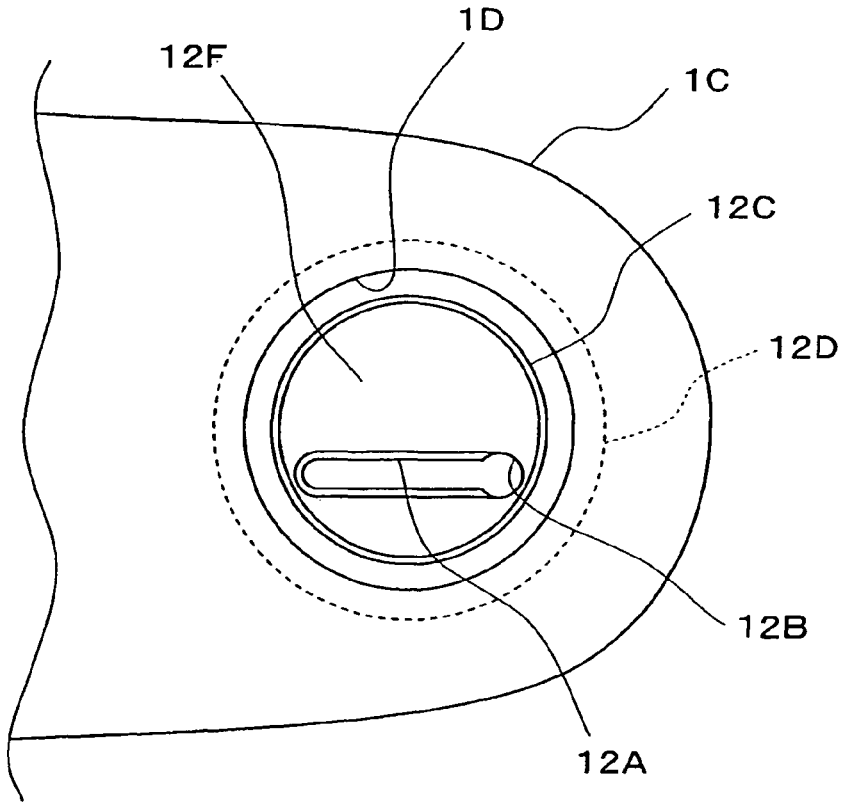
FIG. 6 is a front view which enlarges the guide member which is positioned on the side of the attachment member shown in FIG. 1.

As shown in FIG. 4 and FIG. 6, in the guide member 12, a flange portion 12D is bonded to the surrounding portion of a circular hole 1D, in a condition that an interlocking cylinder portion 12C passes through the circular hole 1D which is formed in the attachment member 1C. As shown in FIG. 6, a long guide hole 12A is formed in the bottom portion 12F of the guide member 12. The interlocking protrusion 11B of the plate member 11 shown in FIG. 3 passes through the long guide hole 12A.

The long guide hole 12A is positioned below the center of the bottom portion 12F of the guide member 12 and extends in a bilateral direction (a cross direction of the golf glove 1). The start point portion 12B on the right side of the long guide hole 12A has a width which allows the head portion 11D of the interlocking protrusion 11B to pass through it, and the other portion of the long guide hole 12A has a width which can guide the neck portion 11C of the interlocking protrusion 11B.

Figure 7A:
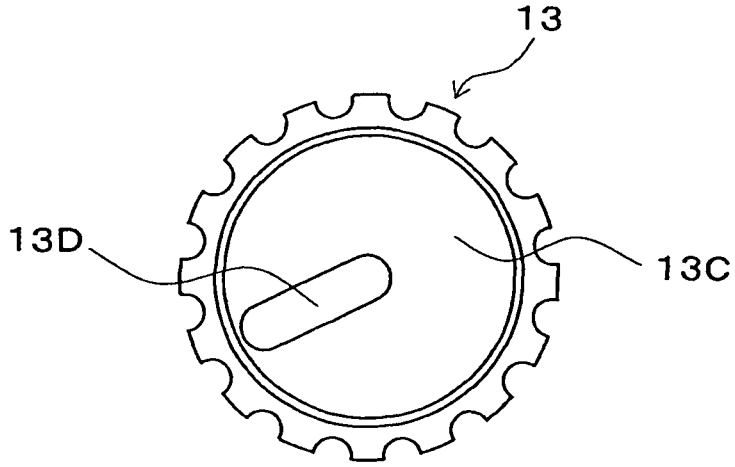
FIG. 7 is a plan view which shows the inner surface of the dial member shown in FIG. 4, wherein (a) shows a linear shaped interlocking groove and (b) shows an arc shaped interlocking groove.
Figure 7B:
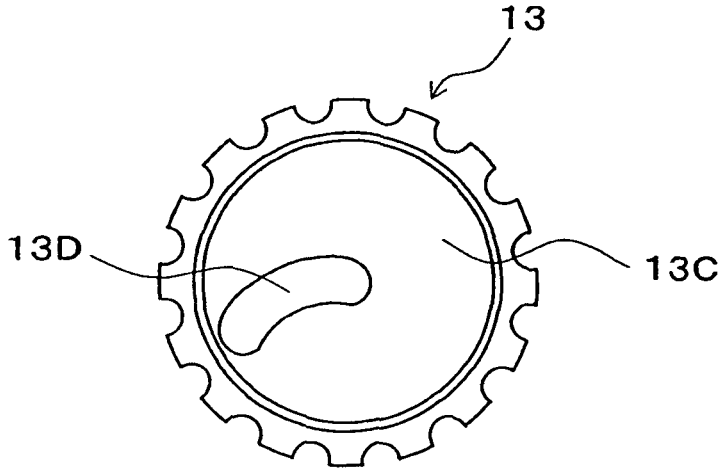
Figure 8:
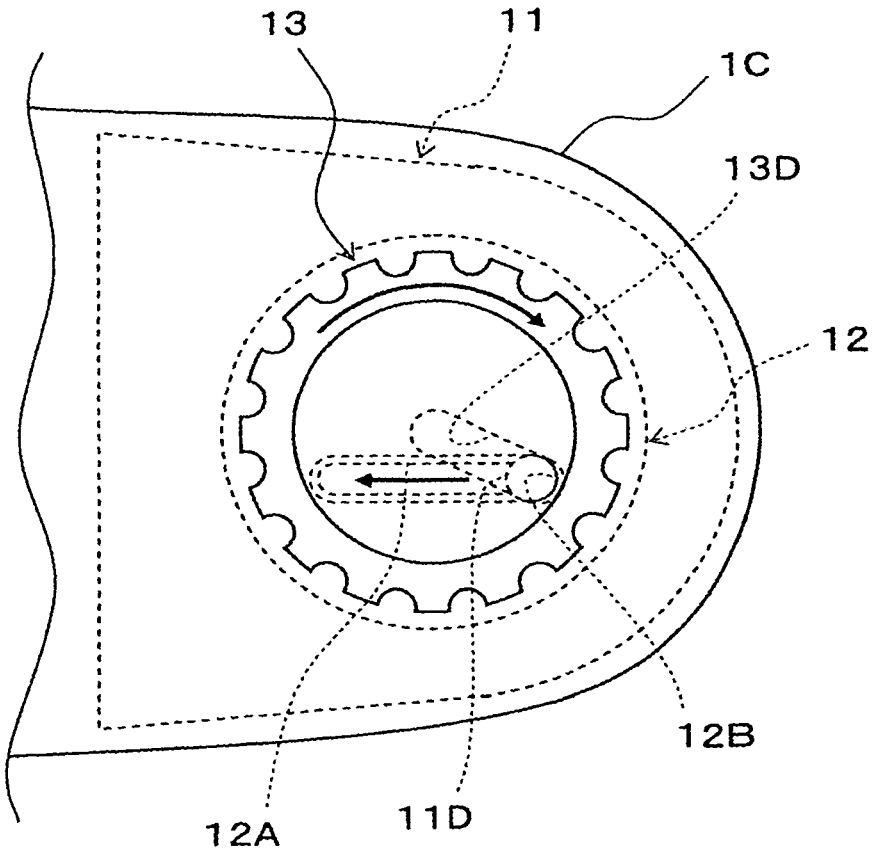
FIG. 8 is a front view of the attachment member showing the operation of the attaching device shown in FIG. 1.

On the other hand, as shown in FIG. 7 and FIG. 8, an interlocking groove 13D is formed on the inner surface of the top portion 13C of the dial member 13 for slidably interlocking with the head portion 11D of the interlocking protrusion 11B which goes through the long guide hole 12A. The interlocking groove 13D may have a linear shape extending from the center of the top portion 13C in a radial direction as shown in FIG. 7(*a*) or an arc shape extending from the center of the top portion 13C in a radial direction as shown in FIG. 7(*b*).

The golf glove 1 according to the first embodiment as described above is put on the left hand of a right-handed golfer, for example. At this time, the guide member 12 on the attachment member 1C is lapped over the plate member 11 on the back of the hand 1A, and the interlocking protrusion 11B of the plate member 11 is positioned to protrude upwardly from the start point portion 12B of the long guide hole 12A in the guide member 12. Then, as shown in FIG. 8 the head portion 11D of the protrusion 11B is interlocked with the interlocking groove 13D of the dial member 13 by rotating the dial member 13, while interlocking the inner circumference of the interlocking cylinder portion 13A of the dial member 13 with the outer circumference of the interlocking cylinder portion 12C of the guide member 12 as shown in FIG. 4.

Such an interlocking condition of the interlocking cylinder portion 13A of the dial member 13 with respect to the interlocking cylinder portion 12C of the guide member 12 is maintained by interlocking a ring shaped convex portion 12E with a ring shaped V-formation groove 13B between them. The position of the dial member 13 in a rotational direction with respect to the guide member 12 is maintained by a plurality of miniature concavo-convex interlocking portion between them. By this action, the golf glove 1 is put on the left hand of a golfer. At this time, no rasping and uncomfortable ripping noises which are peculiar to plane hook-and-loop fasteners used in a conventional golf glove will be generated.

In this worn condition of the golf glove 1, when a golfer attempts to tighten up the attachment member 1C so that the golf glove 1 more closely fits to the left hand, the golfer further rotates the dial member 13 in a clockwise direction as indicated by the arrow which is shown in FIG. 8. Then, the interlocking groove 13D of the dial member 13 pulls the head portion 11D of the interlocking protrusion 11B of the plate member 11 in a direction indicated by the left pointing arrow along the long guide hole 12A of the guide member 12. By this action, the guide member 12 on the attachment member 1C moves relatively in a direction of tightening up the attachment member 1C and the attachment member 1C is further tightened up. At this time, no rasping and uncomfortable ripping noises which are peculiar to plane hook-and-loop fasteners used in a conventional golf glove will be generated.

In other words, according to a golf glove 1 of the first embodiment, the golf glove 1 can be put on the left hand by attaching the attachment member 1C to the back of the hand 1A through the attaching device 10 comprising the plate member 11, the guide member 12 and the dial member 13. Furthermore, the attachment member 1C can be further tightened up in a manner such that the golf glove 1 is put on the left hand more closely fits to the left hand by adjusting the position of the attachment member 1C in a direction of tightening up by the attaching device 10. Since no rasping and uncomfortable ripping noises which are peculiar to plane hook-and-loop fasteners used in a conventional golf glove will be generated during the above mentioned action, the golf glove 1 can be put on or the attachment member 1C can be tightened up without bothering other players even near the teeing ground or the putting green.

Modified Example of First Embodiment

Figure 9A:
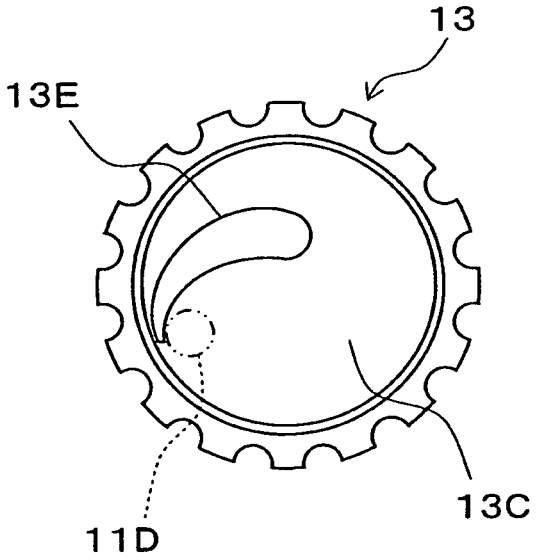
FIG. 9 is a plan view of the inner surface of the dial member which shows a modified example having an interlocking arm in place of the interlocking groove of the dial member shown in FIG. 7, wherein (a) shows a curved shaped interlocking arm and (b) shows a linear shaped interlocking arm.
Figure 9B:
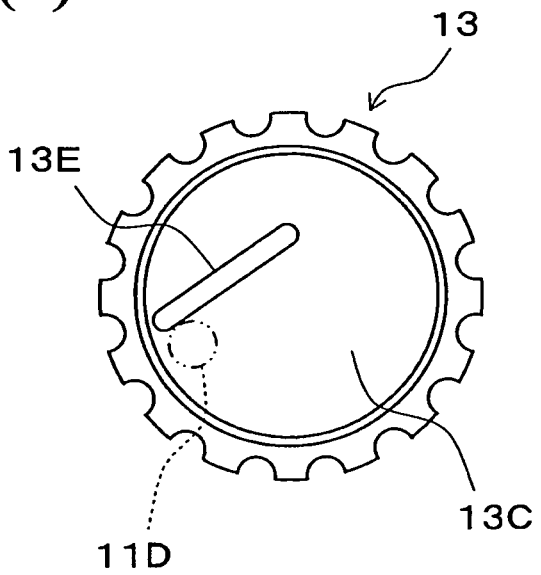

As a modified example of the above mentioned first embodiment, the interlocking groove 13D of the dial member 13 shown in FIG. 7 can be replaced by an interlocking arm 13E as shown in FIG. 9. For example, the interlocking arm 13E has a curved shape which extends from a position which is near the center portion of the top portion 13C of the dial member 13 to the side of the outer circumference as shown in FIG. 9(*a*), however it may have a shape extending linearly as shown in FIG. 9(*b*).

Figure 10:
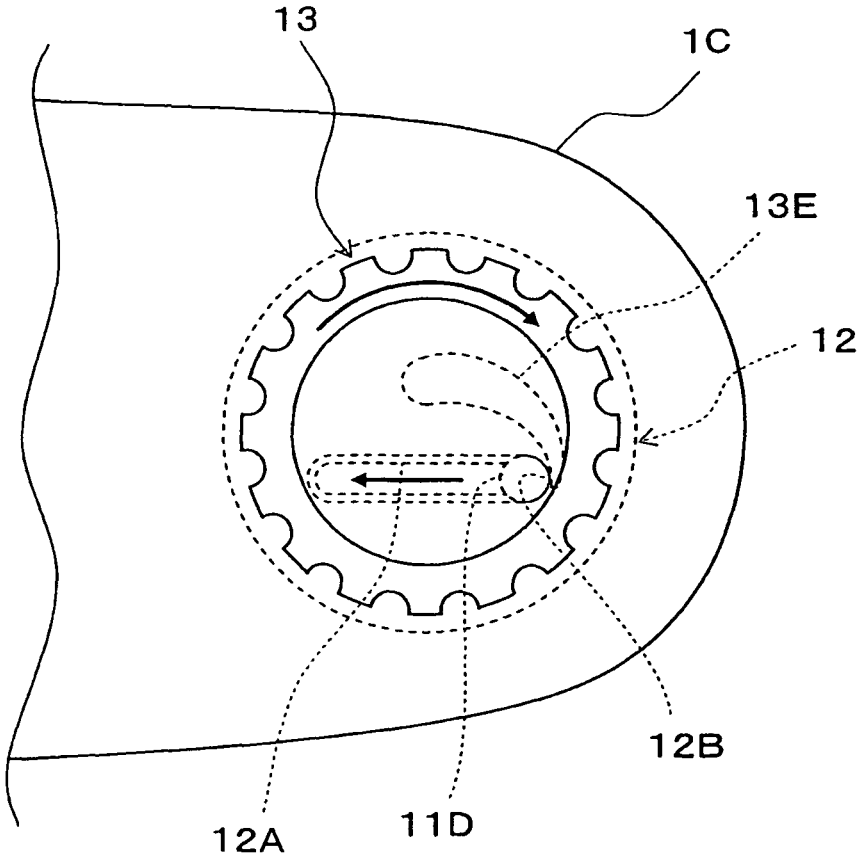
FIG. 10 is a front view of the attachment member showing the operation of the attaching device shown in FIG. 9(*a*) which corresponds to FIG. 8.

In this modified example, when the dial member 13 is rotated in a clockwise direction indicated by the arrow shown in FIG. 10, the interlocking arm 13E of the dial member 13 pushes the head portion 11D of the interlocking protrusion 11B of the plate member 11 toward the left side indicated by the arrow along the long guide hole 12A of the guide member 12.

By this action, the guide member 12 on the attachment member 1C relatively moves in a direction of tightening up the attachment member 1C, and the golf glove 1 is put on the left hand of a golfer. When the dial member 13 is further rotated in a direction which is indicated by the arrow shown in FIG. 10, the attachment member 1C is further tightened up so that the worn golf glove 1 fits more closely to the left hand of a golfer. At this time, no rasping and uncomfortable ripping noises which are peculiar to hook-and-loop fasteners used in a conventional golf glove will be generated. Therefore, an effect which is similar to that of the first embodiment can be obtained in this modified example.

In this modified example of the first embodiment, the long guide hole 12A in the guide member 12 shown in FIG. 10 can be replaced by a ring shaped large opening (not shown in drawings) through which the interlocking protrusion 11B of the plate member 11 passes.

In this case, when the dial member 13 is rotated in a clockwise direction indicated by the arrow shown in FIG. 10, the interlocking arm 13E of the dial member 13 pulls the head portion 11D of the interlocking protrusion 11B toward the left side, then the guide member 12 on the attachment member 1C relatively moves in a direction of tightening up the attachment member 1C, and the golf glove 1 is put on the left hand of a golfer. When the dial member 13 is further rotated in a direction which is indicated by the arrow shown in FIG. 10, the attachment member 1C is further tightened up so that the worn golf glove 1 fits more closely to the left hand of a golfer. At this time, no rasping and uncomfortable ripping noises which are peculiar to hook-and-loop fasteners used in a conventional golf glove will be generated. Therefore, an effect which is similar to that of the first embodiment can be obtained in this modified example.

Second Embodiment

Figure 11:
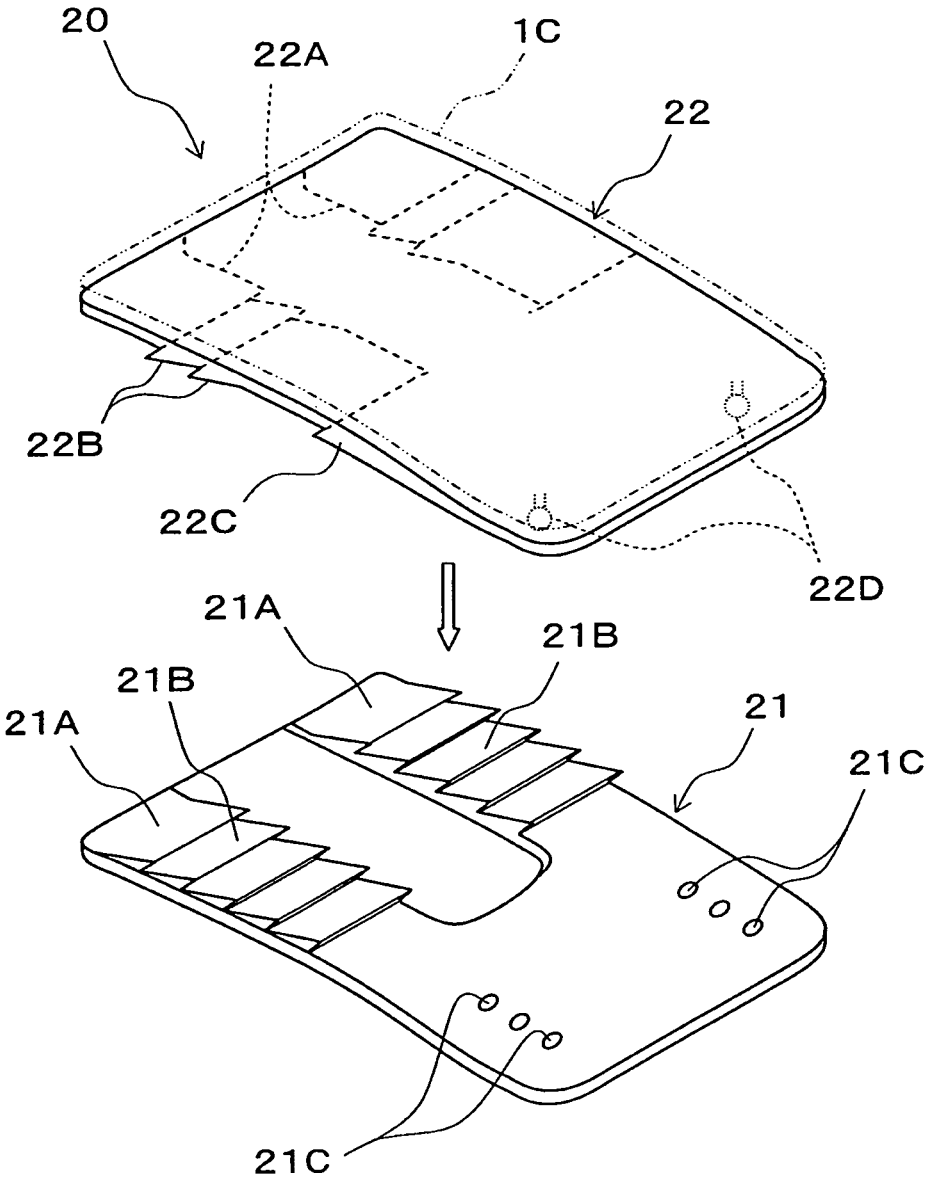
FIG. 11 is a diagrammatic perspective view of a base member and a cover member which constitute an attaching device of a golf glove according to a second embodiment.

In a golf glove 1 according to a second embodiment, the attaching device 10 in the golf glove 1 according to the above described first embodiment, namely the attaching device comprising the plate member 11, the guide member 12 and the dial member 13 shown in FIG. 8 is replaced by an attaching device 20 comprising a base member 21 and a cover member 22 shown in FIG. 11, and the remaining part is configured as same as the golf glove 1 according to the first embodiment.

The base member 21 is a member which is positioned on the side of the back of the hand 1A, and is formed in a roughly rectangular plate which extends in a bilateral direction of the back of the hand 1A and is made of an elastic material like a hard rubber or a soft synthetic resin. This base member 21 is directly bonded or stitched to the back of the hand 1A.

The cover member 22 is a member which is positioned on the side of the attachment member 1C, and is formed in a roughly rectangular plate which laps over the base member 21 and is made of an elastic material like a hard rubber or a soft synthetic resin. This cover member 22 is directly bonded or stitched to the rear surface of the attachment member 1C which is formed to have the roughly same shape as the cover member 22, however the cover member 22 itself may constitute an attachment member.

Ratchet portions 21A, 21A are positioned on the left side of the top surface of the base member 21 (the surface on the side which faces the cover member 22 when the golf glove 1 is put on) so that they are positioned in top and bottom two lines and extend in a bilateral direction in a belt shape, and ratchet teeth 21B of five peaks are formed on each ratchet portion 21A with a predetermined pitch, for example. For example, three locking holes 21C which are respectively positioned in a bilateral direction with a predetermined pitch are formed so that they are positioned in top and bottom two lines on the right side of the base member 21.

On the other hand, ratchet portions 22A, 22A are formed in the left half portion on the bottom surface of the cover member 22 (the surface which faces the base member 21 when a golf glove is put on) in correspondence to the ratchet portions 21A, 21A of the base member 21. In each ratchet portion 22A, for example, ratchet teeth 22B of two peaks are positioned with a predetermined pitch in the left side portion, and a ratchet tooth 22C of one peak is formed in the right side portion. On the bottom surface of the right side portion of the cover member 22, a pair of top and bottom interlocking protrusion 22D, 22D is formed in correspondence to three locking holes 21C positioned in each of two top and bottom lines in the base member 21.

Figure 12:
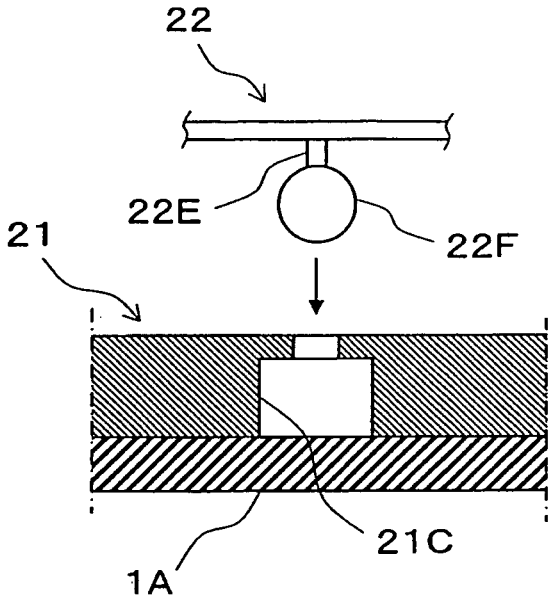
FIG. 12 is a partial cross-sectional view which enlarges the locking hole of the base member and the interlocking protrusion of the cover member shown in FIG. 11.

As shown in FIG. 12, the interlocking protrusion 22D of the cover member 22 has a shape that a head portion 22F with a larger diameter continues to the bottom end of a neck portion 22E with a smaller diameter. In correspondence to this, a locking hole 21C of the base member 21 is formed to have a smaller diameter in the upper portion and forms a stepped hole so as to prevent the head portion 22F of the interlocking protrusion 22D from slipping out by interlocking the head portion 22F in it.

Figure 13:
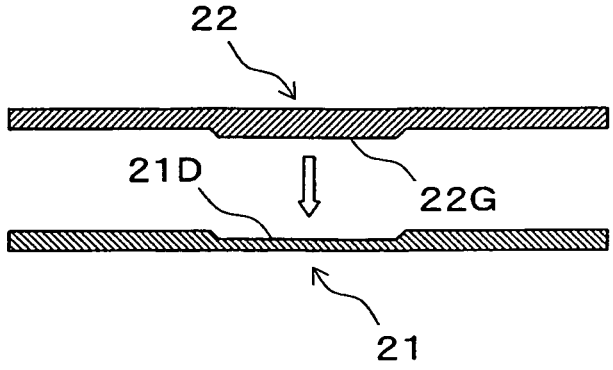
FIG. 13 is a cross-sectional view which shows a groove portion of the base member and a belt shaped protrusion of the cover member shown in FIG. 11.

As shown in FIG. 13, between the ratchet portions 22A, 22A on the bottom surface of the cover member 22, a belt shaped protrusion 22G for sliding is formed to interlock with the groove portion 21D between the ratchet portions 21A, 21A on the top surface of the base member 21.

The orientation of the interlocking slope between each of the ratchet teeth 21B of the ratchet portions 21A, 21A of the base member 21 and the ratchet teeth 22B, 22C of the ratchet portions 22A, 22A of the cover member 22 is set so that the position of the cover member 22 is adjustable with respect to the base member 21 by sliding the cover member 22 in a direction of tightening up the attachment member 1C.

In the golf glove 1 according to the second embodiment, when the golf glove 1 is put on, the cover member 22 on the side of the attachment member 1C is lapped over the base member 21 on the side of the back of the hand 1A, and then the belt shaped protrusion 22G of the cover member 22 is interlocked with the groove portion 21D of the base member 21. After that, the cover member 22 is tightened up in a direction of tightening up the attachment member 1C, and a pair of top and bottom interlocking protrusion 22D, 22D is interlocked with either one of the three pair of locking holes 21C which are respectively positioned in two top and bottom lines on the base member 21.

When the attachment member 1C of the golf glove 1 is further tightened up, the cover member 22 is further tightened up in a direction of tightening up the attachment member 1C, and then the interlocking protrusions 22D, 22D of the cover member 22 are interlocked with another pair of the corresponding locking holes 21C of the base member 21. By this action, the position of the cover member 22 is adjusted in a direction of tightening up the attachment member 1C through the ratchet mechanism comprising each of the ratchet teeth 21B of the ratchet portions 21A, 21A of the base member 21 and the ratchet teeth 22B, 22C of the ratchet portions 22A, 22A of the cover member 22. Then, the attachment member 1C is further tightened up so that the golf glove 1 fits more closely to a hand.

At this time, no rasping and uncomfortable ripping noises which are peculiar to plane hook-and-loop fasteners used in a conventional golf glove will be generated. Therefore, an effect which is similar to that of the first embodiment can be obtained in the second embodiment.

Third Embodiment

In a golf glove 1 according to a third embodiment, the attaching device 20 of the golf glove 1 according to the second embodiment, namely the attaching device 20 comprising the base member 21 and the cover member 22 shown in FIG. 11 is replaced by an attaching device 30 comprising a base member 31 and a slide member 32, and the remaining part is configured as same as the golf glove 1 according to the second embodiment.

The base member 31 is a member which is positioned on the side of the back of the hand 1A, and is formed in a roughly rectangular plate shape extending in a bilateral direction of the back of the hand 1A and is made of a hard rubber or an appropriate synthetic resin. This base member 31 is directly bonded or stitched to the back of the hand 1A.

The slide member 32 is a member which is positioned on the side of the attachment member 1C, and is formed in a roughly rectangle plate shape which laps over the base member 31 and is made of a hard rubber or an appropriate synthetic resin. This slide member 32 is bonded or stitched to the rear surface of the attachment member 1C which is formed in an approximately same shape as that of the slide member 32, however the slide member 32 itself may constitute an attachment member.

On the top surface of the base member 31 (the surface of the side which faces the slide member 32 when the golf glove 1 is put on), a guide rail 31A is formed. The guide rail 31A has a trapezoidal cross-section of a wide-width, and is positioned in the center portion in a vertical direction and extends in a bilateral direction. In correspondence to this, on the undersurface of the slide member 32 (the surface of the side which faces the base member 31 when the golf glove 1 is put on), a guide groove 32A having a trapezoidal cross-section of a wide-width is formed to be slidably interlocked into the guide rail 31A of the base member 31.

In the guide rail 31A of the base member 31, a plurality of magnets 31B is positioned with a predetermined pitch in its longitudinal direction. In correspondence to this, a plurality of magnets 32B is positioned with a predetermined pitch in its longitudinal direction in the guide groove 32A of the slide member 32.

Each of the magnets 31B on the side of the guide rail 31A is buried immediately below the top surface of the guide rail 31A, wherein the polar character of them is aligned in a vertical direction. On the other hand, each of the magnets 32B on the side of the guide groove 32A is buried immediately below the bottom surface of the guide groove 32A, wherein the polar character of them is aligned in a vertical direction so as to be attracted by each of the magnets 31B on the side of the guide rail 31A.

In the golf glove 1 according to the third embodiment, when the golf glove 1 is put on, the slide member 32 on the side of the attachment member 1C is lapped over the base member 31 on the side of the back of the hand 1A, and the guide groove 32A of the slide member 32 is interlocked into the guide rail 31A of the base member 31. By this action, each of the magnets 32B buried in the guide groove 32A with a predetermined pitch is attracted to each of the magnets 31B buried in the guide rail 31A with a predetermined pitch, and then the golf glove is put on.

When the attachment member 1C of the golf glove 1 is further tightened up, the slide member 32 is slid in a direction of tightening up the attachment member 1C with respect to the base member 31. By this action, the position of the slide member 32 is adjusted in a direction of tightening up the attachment member 1C with respect to the base member 31, then the attachment member 1C is further tightened up so that the golf glove 1 fits more closely to a hand.

At this time, no rasping and uncomfortable ripping noises which are peculiar to plane hook-and-loop fasteners used in a conventional golf glove will be generated. Therefore, an effect which is similar to that of the second embodiment can be obtained in the third embodiment.

In the golf glove 1 according to the third embodiment, either one of a group of the magnets 31B or a group of the magnets 32B can be replaced by a single electro magnet or a plurality of electro magnets, and the other group can be replaced by an attracted member which is attracted by the electro magnet(s). Alternatively, the magnet (or the electro magnets) 31B, 32B may be replaced by a ratchet as shown in FIG. 11.

Fourth Embodiment

In a golf glove 1 according to a fourth embodiment, the attaching device 20 of the golf glove 1 according to the second embodiment, namely the attaching device 20 comprising the base member 21 and the cover member 22 shown in FIG. 11 is replaced by an attaching device 40 comprising a base member 41 and a cover member 42, and the remaining part is configured as same as the golf glove 1 according to the second embodiment.

The base member 41 corresponds to the base member 21 shown in FIG. 11, and comprises a ratchet portion 41A, ratchet teeth 41B and a groove portion 41D which corresponds to the ratchet portion 21A, the ratchet teeth 21B and the groove portion 21D of the base member 21, respectively. A pair of locking grooves 41E, 41E which continuously extends to the tip portion of the groove portion 41D is formed on the top surface on the side of the tip portion of the base member 41 (the far end side from the slit 1B in the golf glove 1 shown in FIG. 1).

The cover member 42 corresponds to the cover member 22 shown in FIG. 11, and comprises a ratchet portion 42A, ratchet teeth 42B and a belt shaped protrusion 42G which corresponds to the ratchet portion 22A, the ratchet teeth 22B and the belt shaped protrusion 22G of the cover member 22, respectively. A pair of belt shaped interlocking protrusions 42H, 42H which continuously extends to the tip portion of the belt shaped protrusion 42G is formed on the bottom surface on the side of the tip portion of the cover member 42.

The groove portion 41D of the base member 41 has a reverse trapezoidal cross-section wherein the width of an opening portion is wider than that of the bottom portion, and the locking grooves 41E, 41E of the base member 41 has a trapezoidal cross-section wherein the width of an opening portion is narrower than that of the bottom portion. In response to this, the belt shaped protrusion 42G of the cover member 42 has a reverse trapezoidal cross-section which is smoothly interlocked with the groove portion 41D of the base member 41, and the belt shaped interlocking protrusions 42H, 42H have a trapezoidal cross-section which is dovetail-interlocked with the locking grooves 41E, 41E of the base member 41 by elastic deformation.

In a golf glove 1 according to the fourth embodiment, when a golf glove 1 is put on, the cover member 42 on the attachment member 1C is lapped over the base member 41 on the back of the hand 1A, and the belt shaped protrusion 42G of the cover member 42 is interlocked with the groove portion 41D of the base member 41. And then, by tightening up the cover member 42 in a direction of tightening up the attachment member 1C, a pair of the belt shaped interlocking protrusions 42H, 42H is dovetail-interlocked with the locking grooves 41E, 41E of the base member 41 by elastic deformation.

When the attachment member 1C of the golf glove 1 is further tightened up, the cover member 42 is further tightened up in a direction of tightening up the attachment member 1C. By this action, the position of the cover member 42 is adjusted in a direction of tightening up the attachment member 1C through a ratchet mechanism comprising ratchet portions 41A, 41A of the base member 41 and ratchet portions 42A, 42A of the cover member 42, then the attachment member 1C is further tightened up so that the golf glove 1 fits more closely to a hand.

At this time, no substantial rasping and uncomfortable ripping noises which are peculiar to plane hook-and-loop fasteners used in a conventional golf glove will be generated, because the base member 41 and the cover member 42 are formed by an elastic material like a hard rubber or a soft synthetic resin. Therefore, an effect which is similar to that of the first embodiment can be obtained in the fourth embodiment.

Fifth Embodiment

Figure 15:
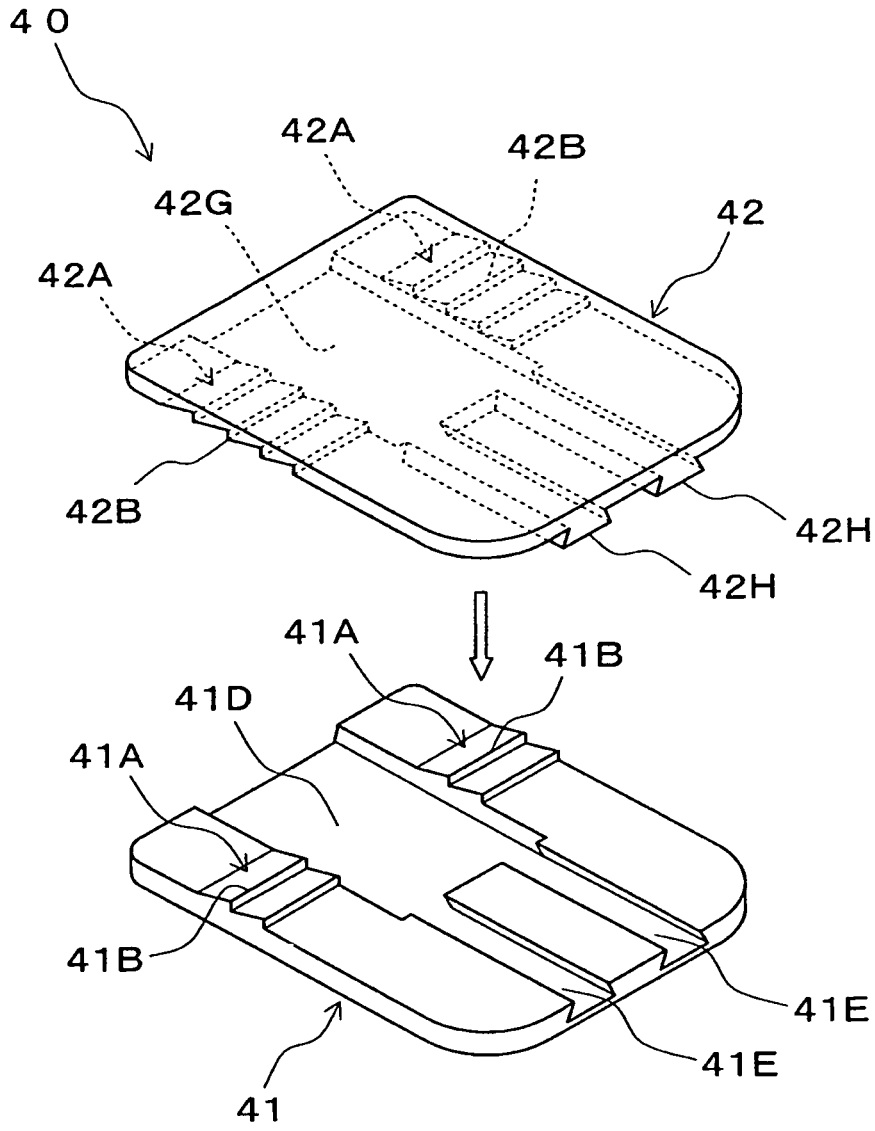
FIG. 15 is a diagrammatic perspective view of a base member and a cover member which constitute an attaching device of a golf glove according to a fourth embodiment.
Figure 16:
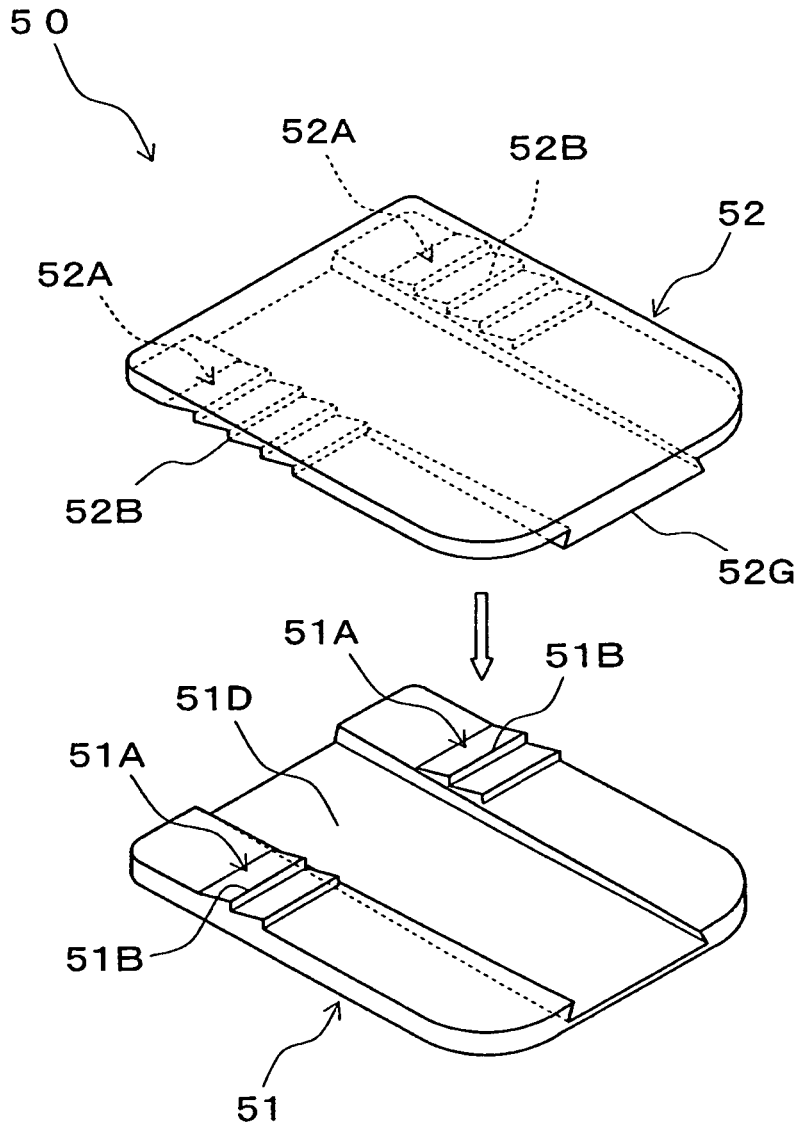
FIG. 16 is a diagrammatic perspective view of a base member and a cover member which constitute an attaching device of a golf glove according to a fifth embodiment.

In a golf glove 1 according to a fifth embodiment, the attaching device 40 of the golf glove 1 according to the fourth embodiment, namely the attaching device 40 comprising the base member 41 and the cover member 42 shown in FIG. 15 is replaced by an attaching device 50 comprising a base member 51 and a cover member 52, and the remaining part is configured as same as the golf glove 1 according to the fourth embodiment.

The base member 51 corresponds to the base member 41 shown in FIG. 15, and comprises a ratchet portion 51A, ratchet teeth 51B and a groove portion 51D which corresponds to the ratchet portion 41A, the ratchet teeth 41B and the groove portion 41D of the base member 41, respectively. The groove portion 51D is formed to extend from the side of the base end where the ratchet portions 51A of the base member 51 are formed to the side of the tip end.

The cover member 52 corresponds to the cover member 42 shown in FIG. 15, and comprises a ratchet portion 52A, ratchet teeth 52B and a belt shaped protrusion 52G which corresponds to the ratchet portion 42A, the ratchet teeth 42B and the belt shaped protrusion 42G of the cover member 42, respectively. The belt shaped protrusion 52G is formed to extend from the side of the base end where the ratchet portions 52A of the cover member 52 are formed to the side of the tip end.

Figure 17A:
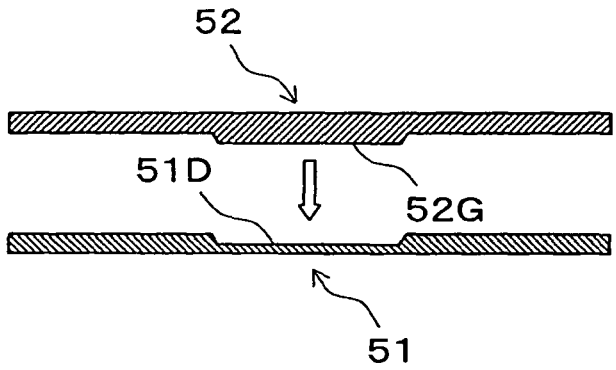
FIG. 17 is a cross-sectional view of an interlocking condition between the groove portion of the base member and the belt shaped protrusion of the cover member shown in FIG. 16, wherein (a) shows a cross-sectional view on the base end side and (b) shows a cross-sectional view on the tip end side.
Figure 17B:
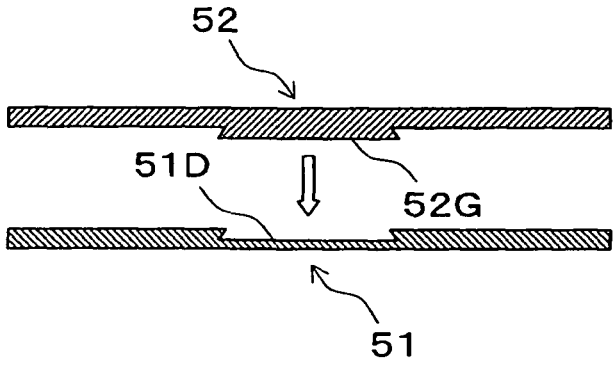

As shown in FIG. 17(*a*), the groove portion 51D of the base member 51 has a reverse trapezoidal cross-section wherein the width of the opening portion is wider than that of the bottom portion, and the belt shaped protrusion 52G on the side of the base end of the cover member 52 has a reverse trapezoidal cross-section which is smoothly interlocked with the groove portion 51D on the side of the base end of the base member 51.

On the other hand, as shown in FIG. 17(*b*), the groove portion 51D on the side of the tip end of the base member 51 has a trapezoidal cross-section wherein the width of the opening portion is narrower than that of the bottom portion, and the belt shaped protrusion 52G on the side of the tip end of the cover member 52 has a trapezoidal cross-section which is dovetail-interlocked with the groove portion 51D on the side of the tip end of the base member 51 by elastic deformation.

Although it is not shown in drawings, the cross-sectional shape of the groove portion 51D of the base member 51 gradually smoothly changes from the cross-sectional shape on the side of the base end of the base member 51 to the cross-sectional shape on the side of the tip end of the base member 51, and the cross-sectional shape of the belt shaped protrusion 52G of the cover member 52 gradually smoothly changes from the cross-sectional shape on the side of the base end of the cover member 52 to the cross-sectional shape on the side of the tip end of the cover member 52.

In a golf glove 1 according to the fifth embodiment, when a golf glove 1 is put on, the cover member 52 on the attachment member 1C is lapped over the base member 51 on the back of the hand portion 1A, and the belt shaped protrusion 52G of the cover member 52 is interlocked with the groove portion 51D of the base member 51. At this time, the belt shaped protrusion 52G on the side of the tip end of the cover member 52 is dovetail-interlocked with the groove portion 51D on the side of the tip end of the base member 51 while elastically deforming the belt shaped protrusion 52G.

When the attachment member 1C of the golf glove 1 is further tightened up, the cover member 52 is further tightened up in a direction of tightening up the attachment member 1C. By this action, the position of the cover member 52 is adjusted in a direction of tightening up the attachment member 1C through a ratchet mechanism comprising ratchet portions 51A, 51A of the base member 51 and ratchet portions 52A, 52A of the cover member 52, then the attachment member 1C is further tightened up so that the golf glove 1 fits more closely to a hand.

At this time, no substantial rasping and uncomfortable ripping noises which are peculiar to plane hook-and-loop fasteners used in a conventional golf glove will be generated, because the base member 51 and the cover member 52 are formed by an elastic material like a hard rubber or a soft synthetic resin. Therefore, an effect which is similar to that of the first embodiment can be obtained in the fifth embodiment.

Sixth Embodiment

Figure 18:
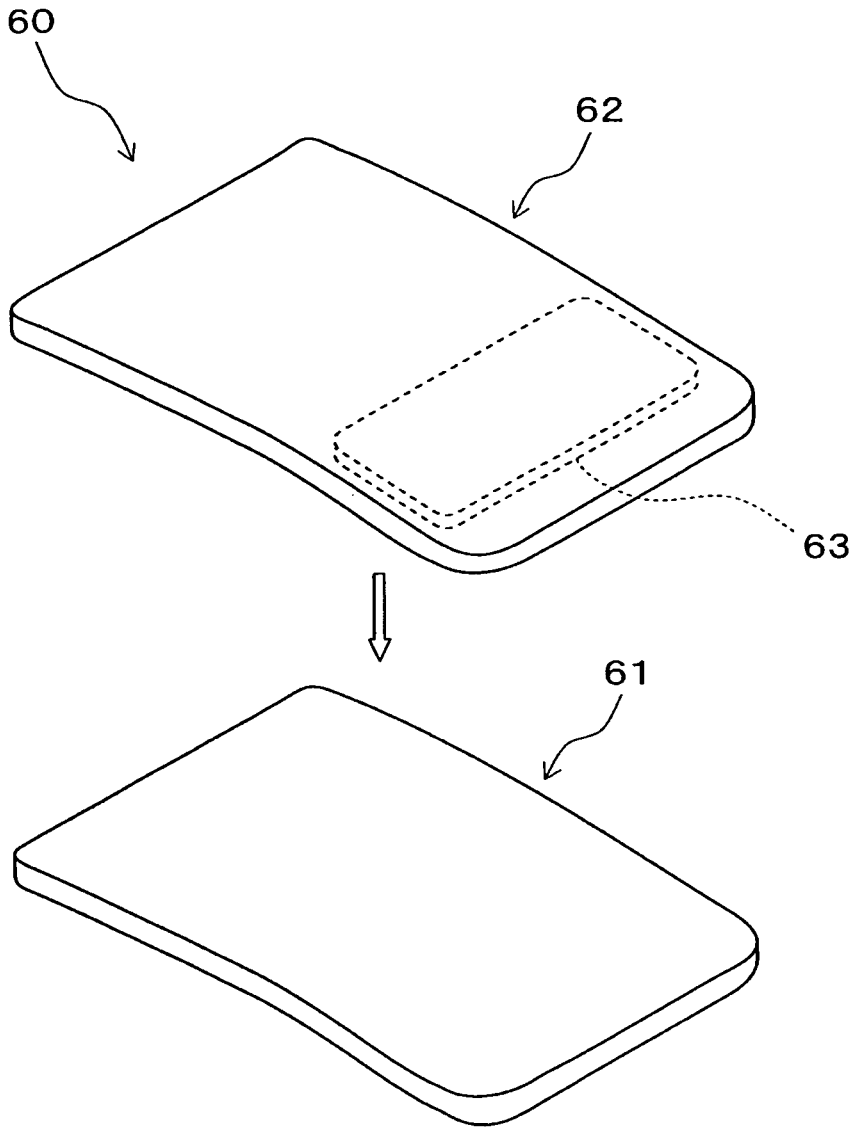
FIG. 18 is a diagrammatic perspective view of a base member and a cover member which constitute an attaching device of a golf glove according to a sixth embodiment.

In a golf glove 1 according to a sixth embodiment, the attaching device 20 of the golf glove 1 according to the second embodiment, namely the attaching device 20 comprising the base member 21 and the cover member 22 shown in FIG. 11 is replaced by an attaching device 60 comprising a base member 61 and a cover member 62 which is shown in FIG. 18. In the attaching device 60, one of at least part of the base member 61 or the cover member 62 (at least part of the surfaces on the side which face each other, when a golf glove 1 is put on) is made of a synthetic resin material which is self-adhesive and removal (hereinafter simply referred as a self-adhesive resin).

As a self-adhesive resin used in at least part of the base member 61 or the cover member 62, a synthetic resin having a property of little adhesiveness, namely a property of adhering to an article by pushing away air when it contacts with the article (i.e. self-adhesiveness) and a property of easily expanding a detached area by lifting up an end of the adhered resin so that the entire portion can be removed (i.e. removability), like acrylic acid ester copolymer, methyl methacrylate-butadiene copolymer, silicon series resin, polyolefin series resin, polyurethane series resin, polystyrene series resin, or their thermal plastic elastomers, is used.

Among these self-adhesive resins, it is preferable to use acrylic acid ester copolymer, methyl methacrylate-butadiene copolymer, polyolefin series resin, polyurethane series resin, polystyrene series resin, or their thermal plastic elastomers in view of easiness to adhere and remove or less temporal degradation of adhesiveness.

The base member 61 shown in FIG. 18 is a member which is positioned on the side of the back of the hand 1A, and comprises a material having a smooth surface with no significant concavo-convex which is made of e.g. vinyl chloride series resin. The base member 61 is formed in a horizontally long roughly rectangular plate shape extending in a bilateral direction of the back and the hand 1A. This base member 61 is directly bonded or stitched to the back of the hand 1A.

On the other hand, the cover member 62 is a member which is positioned on the side of the attachment member 1C, and is formed in a roughly rectangular plate shape which laps over the base member 61. The cover member 62 is directly bonded or stitched to the rear surface of the attachment member 1C which is formed to have the same shape as the cover member 62, however the cover member 62 itself may constitute an attachment member. A locking member 63 which has a roughly same width as the cover member 62 is attached to the rear surface of the cover member 62 (the surface which faces the base member 61 when a golf glove 1 is put on) by a fixing means like bonding so that it is positioned from the center portion toward the right side end of the back of the hand 1A. The locking member 63 is constituted by a self-adhesive resin material.

In a golf glove according to the sixth embodiment, instead of positioning the locking member 63 made of a self-adhesive resin on part of the rear surface of the cover member 62 (the surface on the side which faces the base member 61 when a golf glove 1 is put on) as shown in FIG. 18, a self-adhesive synthetic resin layer may be stacked on the entire surface of the base body of the cover member 62, or the cover member 62 itself may be formed in a self-adhesive synthetic resin.

Alternatively, as a golf glove 1 according to the sixth embodiment, instead of using a self-adhesive synthetic resin material as at least part of surface of the cover member 62 as described above, a locking member 63 made of a self-adhesive resin can be positioned on at least part of the top surface of the base member 61 (the surface on the side which faces the cover member 62 when a golf glove 1 is put on), a self-adhesive resin layer can be stacked on the base body made of e.g. vinyl chloride, or the base member 61 itself can be formed by a self-adhesive resin. In this case, the adhesive characteristics between the base member 61 and the cover member 62 can be improved by using e.g. a vinyl chloride resin material having a smooth surface with no significant concavo-convex as the cover member 62 instead of a self-adhesive synthetic resin material (the same material as the base member 61).

Figure 14:
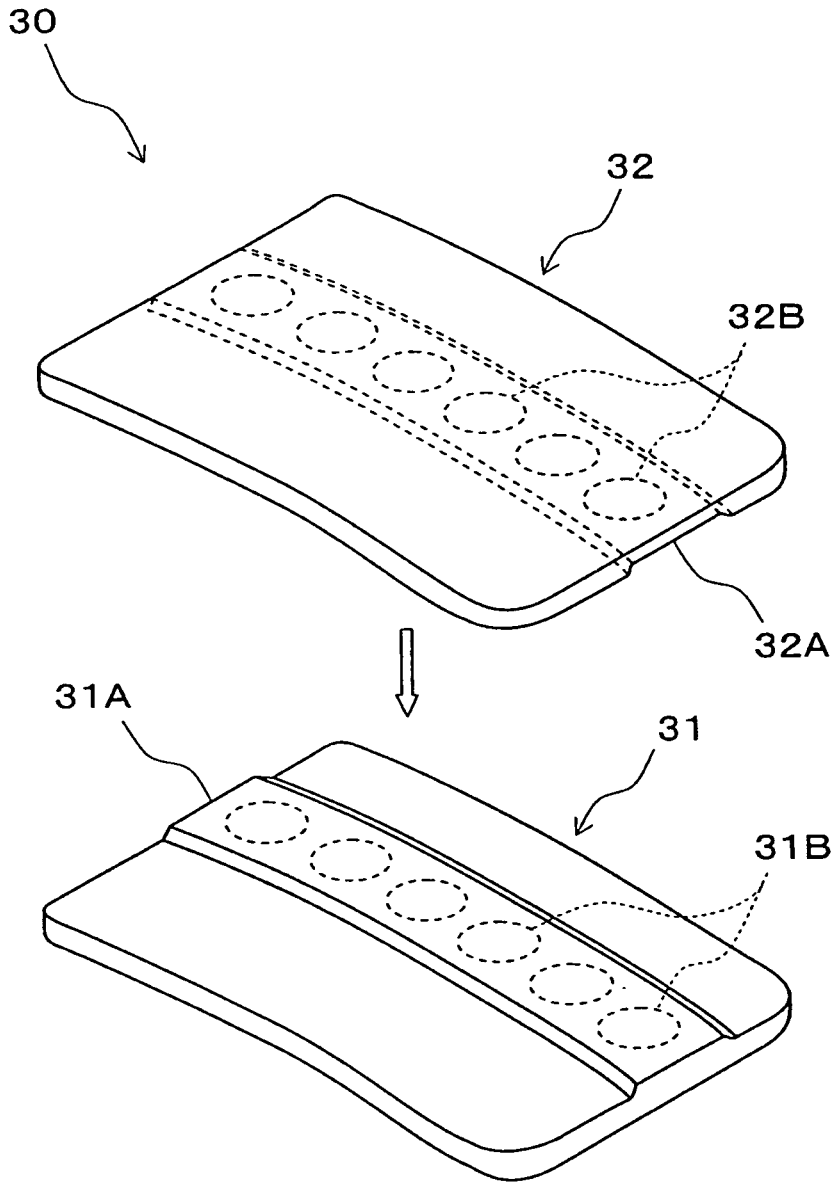
FIG. 14 is a diagrammatic perspective view of a base member and a slide member which constitute an attaching device of a golf glove according to a third embodiment.

As a golf glove 1 according to the sixth embodiment, a configuration which is similar to the golf glove 1 according to the third embodiment can be used except that the material for at least part of the surface of the guide rail 31A or the guide groove 32 in the attaching device 30 in the golf glove 1 according to the third embodiment shown in FIG. 14 is formed by a self-adhesive resin material. In this case, a group of magnets 31B or a group of the magnets 32B needs not to be provided in the guide rail 31A or the guide groove 32.

In the golf glove 1 according to the sixth embodiment of the present invention as described above, when a golf glove 1 is put on, the cover member 62 on the side of the attachment member 1C is lapped over the base member 61 on the side of the hand 1A, and pressed from the side of the cover member 62. Then, the golf glove 1 is put on by fixing the cover member 62 onto the base member 61.

When the attachment member 1C of the golf glove 1 is further tightened up, the cover member 62 is grabbed and detached from the base member 61 once, and the cover member 62 is pulled in a direction of tightening up the attachment member 1C with respect to the base member 61. By this action, the position of the cover member 62 is adjusted in a direction of tightening up the attachment member 1C is adjusted with respect to the base member 61, the attachment member 1C is further tightened up so that the golf glove 1 fits more closely to a hand.

No rasping and uncomfortable ripping noises which are peculiar to plane hook-and-loop fasteners used in a conventional golf glove will be generated when the attachment member 1C is further tightened up, because it is easy to adhere (or remove) the base member 61 to (from) the cover member 62 which the contacting surface (the adhered surface) of either the base member 61 or the cover member 62 is formed by a self-adhesive resin material. Therefore, an effect which is similar to those of the second embodiment and the third embodiment can be obtained in a golf glove 1 according to the sixth embodiment of the present invention.

The invention claimed is:

1. A golf glove, comprising:

an attachment member for tightening up which is lapped over and removably attached to a back of a hand, and an attaching device positioned between the back of the hand and the attachment member for attaching the attachment member so that a position of the attachment member is adjustable in a direction of tightening up the attachment member.

2. A golf glove according to claim 1, wherein the attaching device includes a plate member positioned on a side of the back of the hand and a guide member and a dial member positioned on a side of the attachment member, the plate member has an interlocking protrusion which passes through a long guide hole formed in the guide member and is interlocked with an interlocking groove or an interlocking arm formed in the dial member, the dial member is configured to rotate with respect to the guide member and determines a position in a rotational direction, and the attachment member is attached to the back of the hand and the attachment member moves in the direction of tightening up by an action that the interlocking groove or the interlocking arm pulls the interlocking protrusion of the plate member along the long guide hole of the guide member through rotation of the dial member.

3. A golf glove according to claim 2, wherein, an opening through which the interlocking protrusion passes is formed in the guide member instead of the long guide hole.

4. A golf glove according to claim 1, wherein the attaching device includes a base member positioned on a side of the back of the hand and a cover member positioned on a side of the attachment member, the cover member is removable with respect to the base member, and a position of the cover member is adjustable in the direction of tightening up the attachment member through a ratchet mechanism, and at least one of the base member or the cover member is formed by an elastic material.

5. A golf glove according to claim 1, wherein the attaching device includes a base member positioned on a side of the back of the hand and a slide member positioned on a side of the attachment member, and the slide member is attracted with respect to the base member in the direction of tightening up the attachment member through a magnet so that a position of the slide member is adjustable.

6. A golf glove according to claim 1, wherein the attaching device includes a base member positioned on a side of the back of the hand and a cover member positioned on a side of the attachment member, and at least part of a surface of at least one of the base member or the cover member is made of a synthetic resin having self-adhesiveness and removability.

* * * * *